US007886732B1

(12) United States Patent
Liao

(10) Patent No.: US 7,886,732 B1
(45) Date of Patent: Feb. 15, 2011

(54) HEATING STRUCTURE OF A GASIFICATION TANK IN AN ACTION

(75) Inventor: Yin-Hsi Liao, Sijhih (TW)

(73) Assignee: Guay Guay Trading Co., Ltd., Taipei County (TW)

( * ) Notice: Subject to any disclaimer, the term of this patent is extended or adjusted under 35 U.S.C. 154(b) by 30 days.

(21) Appl. No.: 12/546,431

(22) Filed: Aug. 24, 2009

(51) Int. Cl.
*F41B 11/00* (2006.01)

(52) U.S. Cl. ..... 124/74; 124/1

(58) Field of Classification Search ..... 124/1, 124/32, 71–77; 89/7
See application file for complete search history.

(56) References Cited

U.S. PATENT DOCUMENTS 3,951,038 A * 4/1976 Van Langenhoven ..... 89/7
5,331,879 A * 7/1994 Loffler ..... 89/8

* cited by examiner

*Primary Examiner*—Troy Chambers
(74) *Attorney, Agent, or Firm*—Leong C. Lei

(57) ABSTRACT

A heating structure of a gasification tank in an action includes a furniture which is provided with an action and an interior of the action is provided with a gasification tank and a gas cylinder. A wall of the gasification tank in the action is provided with at least one electrothermal pad by which gas passing through the gasification tank can be heated up, avoiding that air pressure is reduced as air temperature in the gasification tank is too low, as the present invention can effectively and continuously heat up the air in the gasification tank.

6 Claims, 5 Drawing Sheets

HEATING STRUCTURE OF A GASIFICATION TANK IN AN ACTION

BACKGROUND OF THE INVENTION a) Field of the Invention

The present invention relates to a heating structure and more particularly to a heating structure which can heat up gas in a gasification tank of an action.

b) Description of the Prior Art

A survival game has already been a leisure activity which people are often taking. People can use toy guns in hands to emulate a real field combat situation and can play team games with others to develop a tacit understanding of the games and to obtain an entertainment effect.

However, a toy gun usually uses air as its power source to achieve a shooting effect by air to drive the bullets in a frame and the power source can keep providing to the toy gun using only a gas cylinder in the clip, when shooting.

Nevertheless, when the aforementioned toy gun is used, following issue and shortcoming actually exist to be improved.

When temperature of air in the gas cylinder of the toy gun which uses the gas cylinder as the power source is lower, it will usually result in an issue of incomplete gasification and when the gasification is not complete, air pressure will be insufficient to further cause an issue of not having sufficient power.

Accordingly, how to solve the aforementioned issue and shortcoming of a prior art is a direction of improvement for research and development by the present inventor and related vendors.

SUMMARY OF THE INVENTION

The primary object of the present invention is to provide a heating structure of a gasification tank.

To achieve the aforementioned object, the present invention includes a furniture which is provided with an action. An interior of the action includes a gasification tank and a gas cylinder and a wall of the gasification tank in the action is provided with at least one electrothermal pad. By the provision of the electrothermal pad, gas which passes through the gasification tank can be heated up.

As the wall of the gasification tank of the present invention is provided with the electrothermal pad, when air in the gas cylinder passes through the gasification tank, temperature of air in the gasification tank can keep at a fixed value by the electrothermal pad, avoiding that air pressure is reduced as the air temperature in the gasification tank is too low, which further causes an issue of insufficient power. Accordingly, the issue in the prior art that the pressure is insufficient as the air temperature in the gasification tank is too low can be solved, as the present invention can heat up the air in the gasification tank to effectively increase the air pressure.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
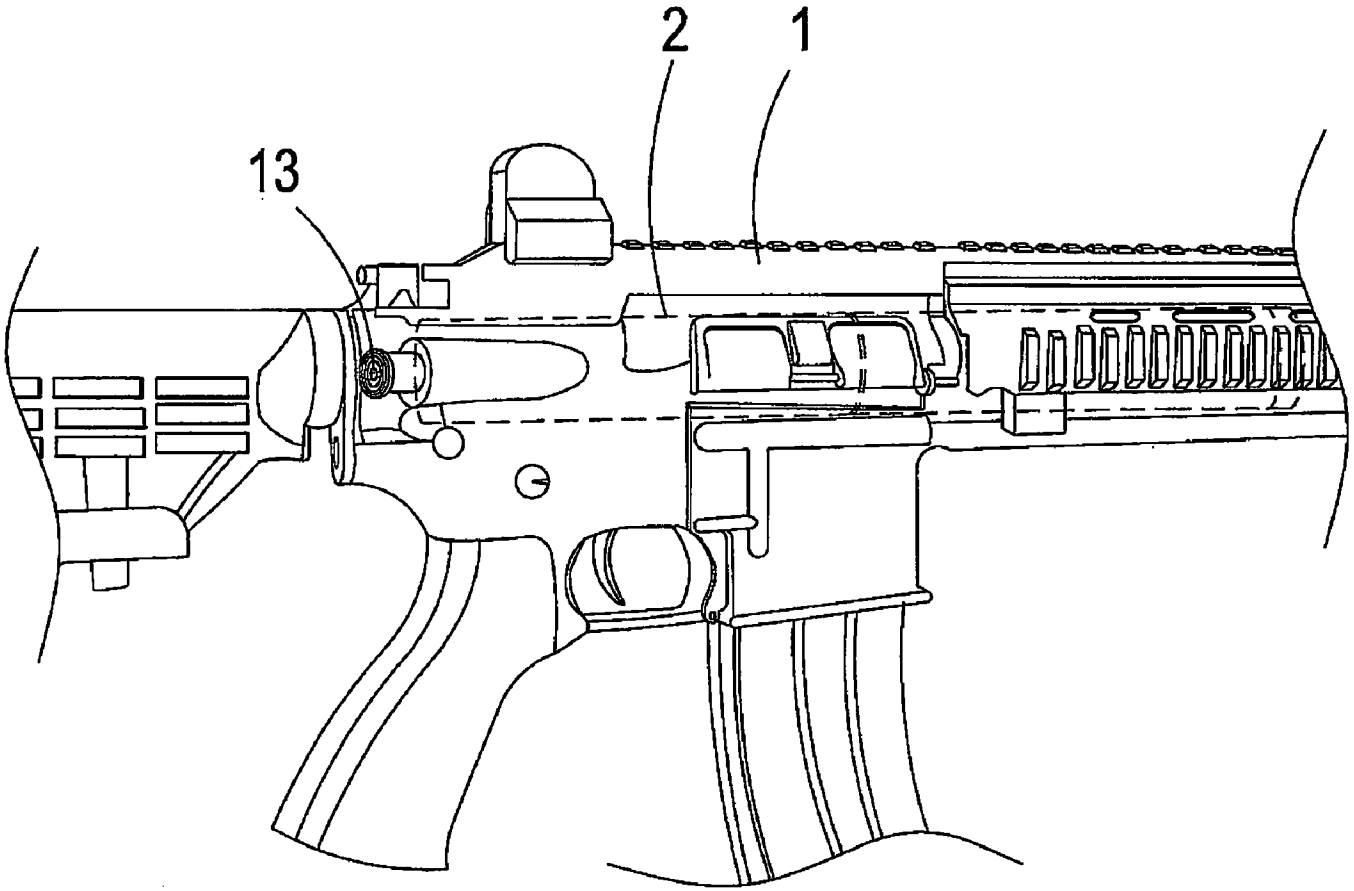
FIG. 1 shows a three-dimensional view of a preferred embodiment of the present invention.
Figure 2:
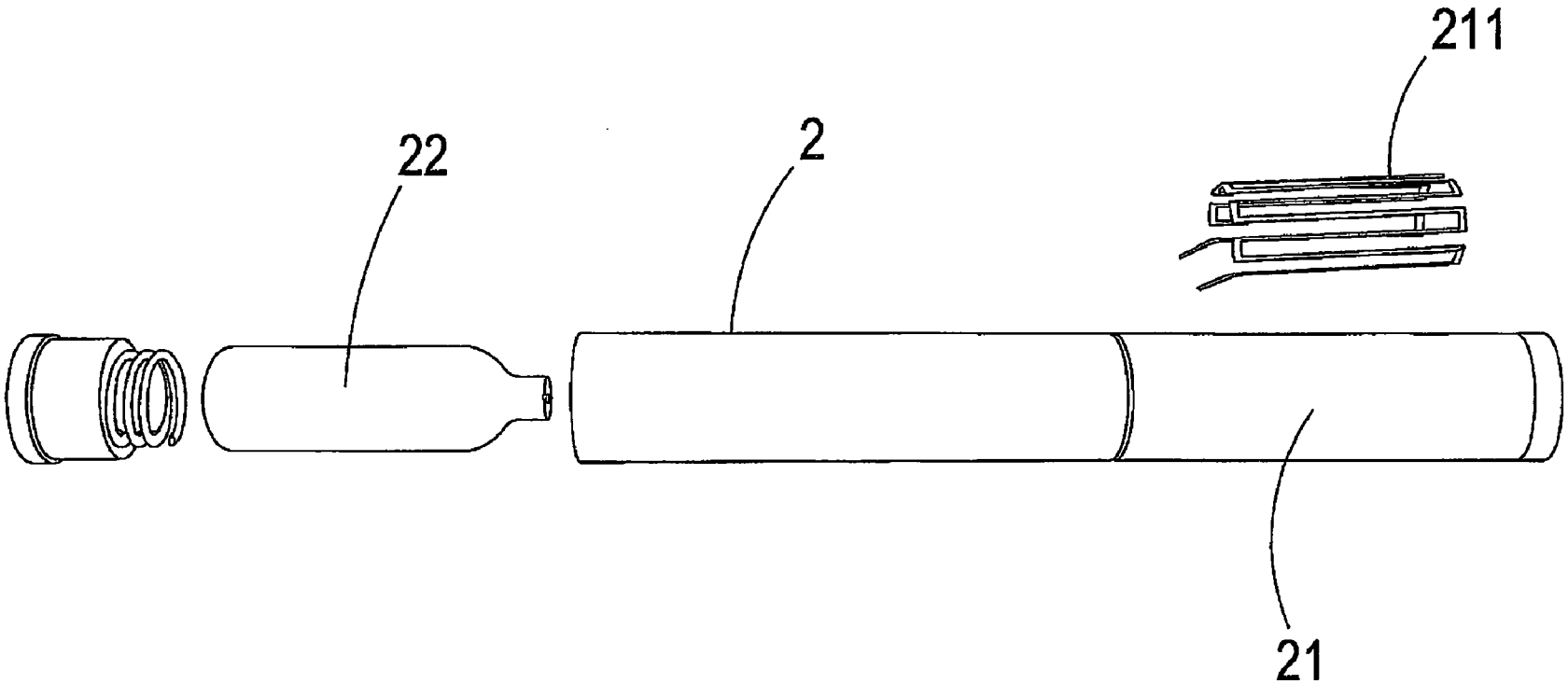
FIG. 2 shows a three-dimensional exploded view of a preferred embodiment of the present invention.
Figure 3:
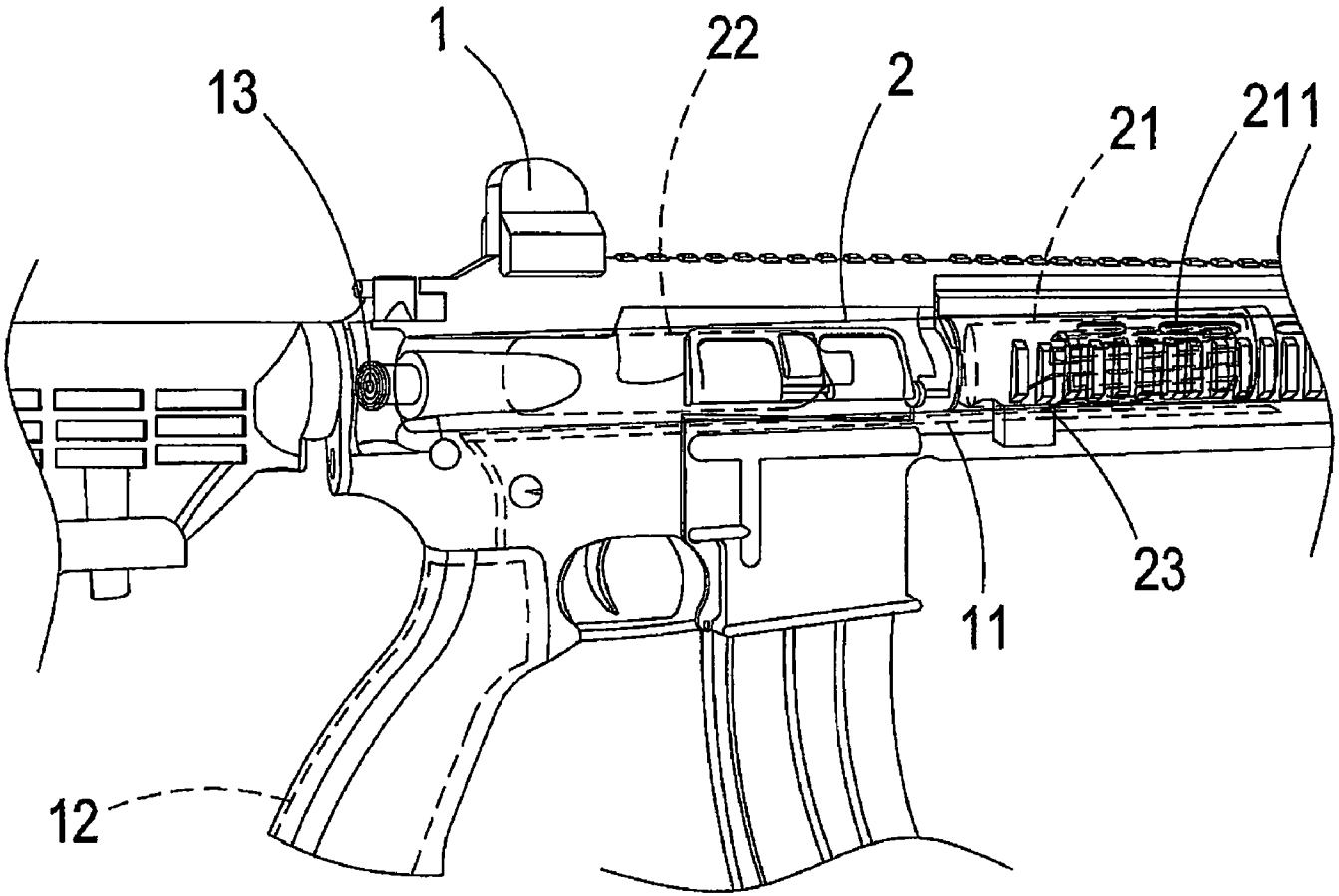
FIG. 3 shows a perspective view of a preferred embodiment of the present invention.

Referring to FIGS. 1 to 3, it shows a three-dimensional view, a three-dimensional exploded view and a perspective view, of a preferred embodiment of the present invention. As shown in the drawings, the present invention comprises a furniture 1 which includes an action 2 and an interior of the action 2 is provided with a gasification tank 21 and a gas cylinder 22. A wall of the gasification tank 21 in the action 2 is provided with at least one electrothermal pad 211 and an outer wall of the action 2 is formed with at least a junction 23 which is electrically connected with the electrothermal pad 211. A proper position of the furniture 1 is provided with at least a rail of anode and cathode 11 which corresponds to the junction 23 and is electrically connected to a battery 12. By the provision of the electrothermal pad 211, gas which passes through the gasification tank 21 can be heated up.

The gas cylinder 12 is filled with high pressure carbon dioxide and the furniture 1 is provided with a temperature adjustment knob 13 to control temperature of the electrothermal pad 211.

Figure 4:
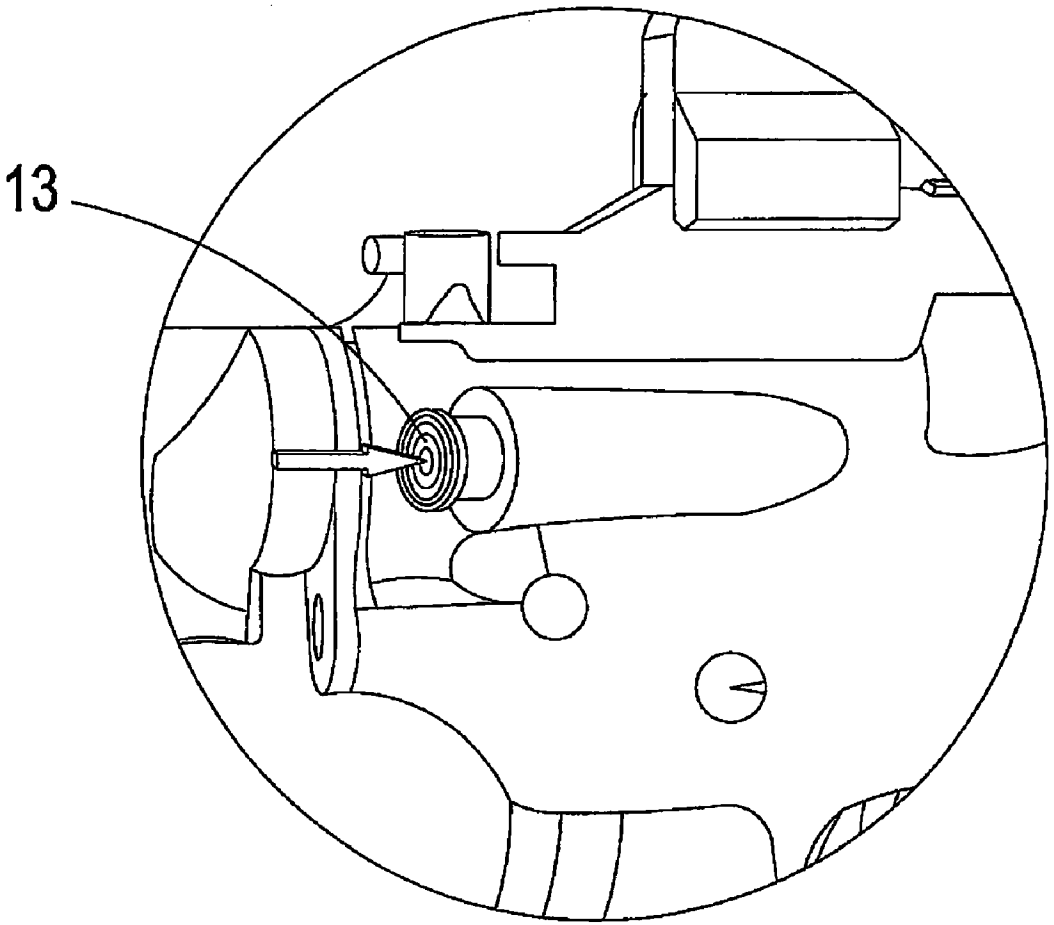
FIG. 4 shows a first schematic view of an implementation of a preferred embodiment of the present invention.
Figure 5:
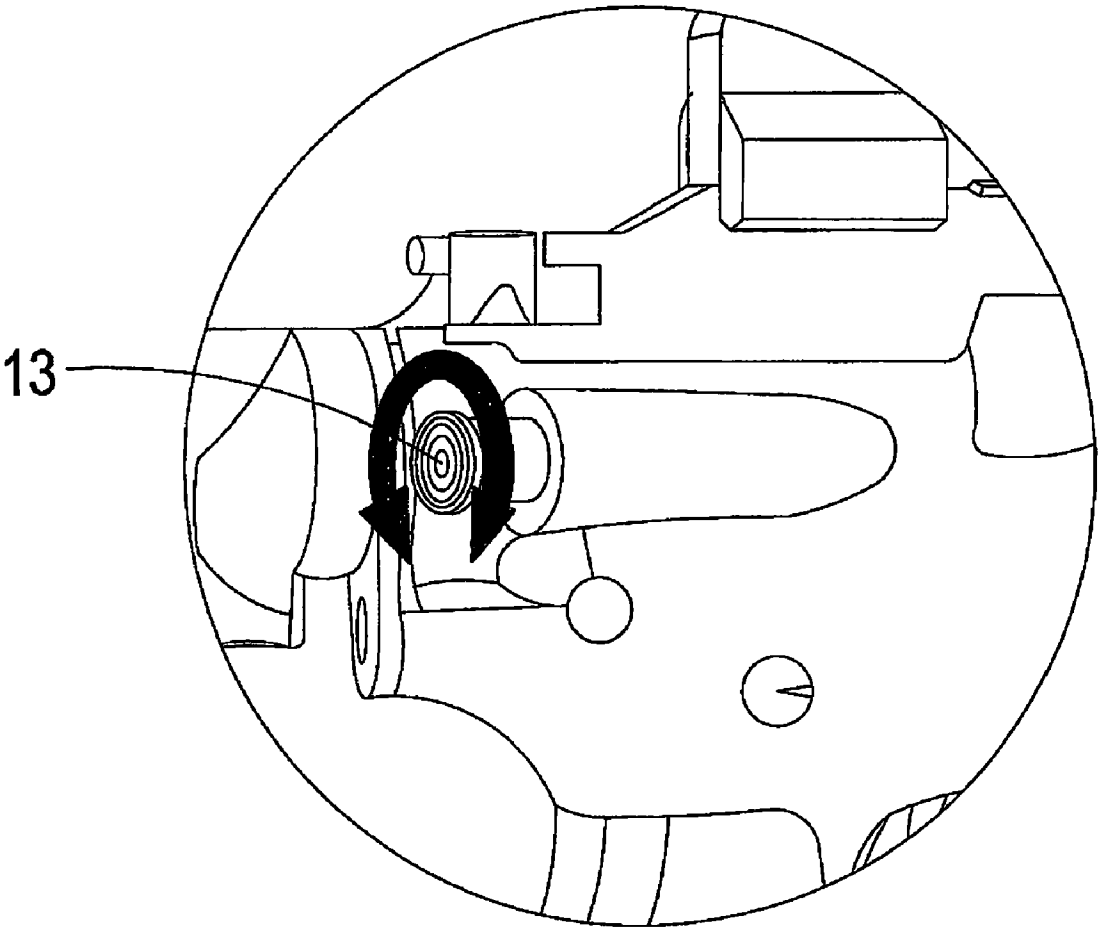
FIG. 5 shows a second schematic view of an implementation of a preferred embodiment of the present invention.

Referring to FIGS. 3 to 5, it shows a perspective view, a first schematic view of an implementation and a second schematic view of an implementation, of a preferred embodiment of the present invention. As shown in the drawings, as the wall of the gasification tank 21 in the action 2 is provided with at least one electrothermal pad 211 and the furniture 1 is provided with the temperature adjustment knob 13 to control the temperature of the electrothermal pad 211, when air temperature in the gasification tank 21 is not high enough, a user can press the temperature adjustment knob 13 to expedite heating (as shown in FIG. 4) and can also rotate the temperature adjustment knob 13 to finely adjust the temperature of the electrothermal pad 211 (as shown in FIG. 5). Accordingly, the present invention can effectively heat up the temperature in the gasification tank 21, avoiding that air pressure is reduced as the air temperature in the gasification tank 21 is too low.

By the aforementioned structures, the gasification tank 21 in the action 2 can keep at certain temperature and further acquire stronger air pressure, such that when the user employs the action 2 to shoot bullets, the bullets can have a higher shooting speed and the action 2 can maintain a stable power source.

Accordingly, referring to all the drawings, the present invention is indeed provided with a following advantage when comparing with the prior art.

In the present invention, the wall of the gasification tank 21 in the action 2 is provided with at least one electrothermal pad 211 by which the air in the gasification tank 21 can be heated up, avoiding that the air pressure is reduced as the air temperature in the gasification tank 21 is too low, which further causes an issue of insufficient power.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A heating structure of a gasification tank in an action, comprising a furniture which includes an action, with an interior of the action being provided with a gasification tank and a gas cylinder, wherein a wall of the gasification tank in the action is provided with at least one electrothermal pad by which gas passing through the gasification tank is heated up.

2. The heating structure of a gasification tank in an action, according to claim 1, wherein the gas cylinder is filled with high pressure carbon dioxide.

3. The heating structure of a gasification tank in an action, according to claim 1, wherein an outer wall of the action is formed with at least one junction which is electrically connected with the electrothermal pad.

4. The heating structure of a gasification tank in an action, according to claim 3, wherein a proper position of the furniture is provided with at least a rail of anode and cathode corresponding to the junction.

5. The heating structure of a gasification tank in an action, according to claim 4, wherein the rail of anode and cathode is connected to a battery.

6. The heating structure of a gasification tank in an action, according to claim 1, wherein the furniture is provided with a temperature adjustment knob to control temperature of the electrothermal pad.

* * * * *